US010246889B1

(12) United States Patent
Nogueras

(10) Patent No.: US 10,246,889 B1
(45) Date of Patent: Apr. 2, 2019

(54) STRIP ANCHORING SYSTEM FOR EMERGENCY ROOF TARP INSTALLATION

(71) Applicant: Alexis Nogueras, Miami, FL (US)

(72) Inventor: Alexis Nogueras, Miami, FL (US)

( * ) Notice: Subject to any disclaimer, the term of this patent is extended or adjusted under 35 U.S.C. 154(b) by 0 days.

(21) Appl. No.: 15/960,605

(22) Filed: Apr. 24, 2018

(51) Int. Cl.
*E04B 7/00* (2006.01)
*E04G 23/00* (2006.01)
*E04B 7/02* (2006.01)

(52) U.S. Cl.
CPC ..... *E04G 23/00* (2013.01); *E04B 7/02* (2013.01)

(58) Field of Classification Search
CPC . E04G 23/00; E04G 23/0281; E04G 23/3233; E04G 21/28; E04B 1/34
USPC ..... 52/3, 23
See application file for complete search history.

(56) References Cited

U.S. PATENT DOCUMENTS 4,455,790 A 6/1984 Curie
4,682,447 A * 7/1987 Osborn ..... A47G 21/167 52/3
5,388,311 A 2/1995 Solbeck
5,983,572 A * 11/1999 Laboy ..... E04B 7/02 52/23
6,474,022 B1 11/2002 Double et al.
6,966,152 B2 11/2005 Glynos
7,299,588 B2 11/2007 Diaz et al.
7,392,620 B1 * 7/2008 Watson, Jr. ..... E04H 9/14 52/4
8,777,516 B2 7/2014 Slutz
8,984,815 B1 * 3/2015 LaFour ..... E04G 21/28 52/202
9,021,749 B2 5/2015 Poldmaa
9,327,147 B2 5/2016 Snider et al.
9,797,154 B1 * 10/2017 McKinney ..... E04G 21/28
2002/0007924 A1 1/2002 Hendee
2002/0095898 A1 7/2002 Bettencourt
2005/0217202 A1 10/2005 Crook
2006/0010815 A1 1/2006 Dixon et al.
2006/0150537 A1 * 7/2006 Baum ..... A01F 25/13 52/90.1
2006/0185706 A1 * 8/2006 Slade ..... E04G 21/28 135/122
2009/0013610 A1 1/2009 Glynos
2010/0083587 A1 4/2010 Glynos

OTHER PUBLICATIONS

HTRC, "7 Steps to temporarily patch your roof with a tarp"; Dec. 3, 2013.*

* cited by examiner

*Primary Examiner* — Beth A Stephan
(74) *Attorney, Agent, or Firm* — Albert Bordas, P.A.

(57) ABSTRACT

A strip anchoring system for emergency roof tarp installations, having at least one strip assembly, which has a top face having a top cut out and a top cut out face, and a bottom face having a bottom cut out, a bottom cut out face, and a retaining strip, wherein the at least one strip assembly secures a tarp on a roof. A plurality of strip assemblies may be assembled linearly and/or at ninety degrees.

17 Claims, 4 Drawing Sheets

STRIP ANCHORING SYSTEM FOR EMERGENCY ROOF TARP INSTALLATION

BACKGROUND OF THE INVENTION

1. Field of the Invention

The present invention relates to temporary roof protection, and more particularly, to strip anchoring systems to fix tarps on roofs.

2. Description of the Related Art

Applicant believes that one of the closest references corresponds to U.S. Pat. No. 4,455,790 issued to Pierre W. Curle on Jun. 26, 1984 for Tarpaulin anchoring system. However, it differs from the present invention because Curle teaches a tarpaulin anchoring system for retaining a tarpaulin on a pile of stored grain or other granular material that comprises a plurality of anchors embedded in the pile. Each anchor has an attachment element protruding upwardly from the pile, with the attachment element being connected to a fastener affixed to the underside of the tarpaulin. The anchors are placed in the grain pile, throughout the area covered by the tarpaulin, as required to retain it in place. The anchors themselves may be of a screw or auger type, which can be driven into an existing grain pile and attached to a tarpaulin as it is spread over the pile. In the case where a tarp is suspended above a grain storage area prior to formation of the grain pile, the anchors may be discs or plates attached to the underside of the tarpaulin by ropes; the anchors are buried in the pile when formed.

Applicant believes that another reference corresponds to U.S. Pat. No. 5,388,311 issued to Peter Solbeck on Feb. 14, 1995 for Fastening and locking device for tarpaulins and similar coverings. However, it differs from the present invention because Solbeck teaches a fastening and locking device for tarpaulins and similar weather protective covering materials includes a pluglike member to be mounted in an eyelet with a head in abutment against one side of the tarpaulin and in connection therewith a shank portion projecting through the eyelet opening towards the opposite side of the tarpaulin, the shank portion having a smaller diameter than the head, in which a transverse channel is provided for receiving an anchoring or locking member.

Applicant believes that another reference corresponds to U.S. Pat. No. 6,474,022 issued to Double, et al. on Nov. 5, 2002 for Multi-purpose tarpaulin system. However, it differs from the present invention because Double, et al. teach a weather resistant commodity stockpile and collection pond covering system made up of a plurality of sheets joined together in waterproof seams. A plurality of flexible cords are tightly encapsulated and fixed in each sheet at spaced apart locations within thermally welded prayer seams and utilized for retention of the cover system and the hanging of ballast bags. The peeling stresses on the prayer seams are transferred as shearing stresses to lap seams formed by welding choker strips to the cover sheets on either side of each prayer seam. Side cords encapsulated in edge seams along side edges of adjacent sheets are abutted together and secured by flexible ties to form joints between sheets. Those joints are made waterproof by edge flaps attached to the sheets, which are extended over each joint and sealed to the face of an adjoining sheet.

Applicant believes that another reference corresponds to U.S. Pat. No. 6,966,152 issued to Peter N. Glynos on Nov. 22, 2005 for Protective tarp with plural separated anchors.

However, it differs from the present invention because Glynos teaches a protective tarp for covering a mass that includes a flat, flexible sheet material having a top and a bottom and having a peripheral edge, e.g. a plurality of edges. Along the peripheral edge or along each of at least two of the plurality of edges, there is a plurality of unconnected tank compartment anchors, arranged in a predetermined pattern, that have at least one fill orifice and closure means for the fill orifice. The plurality of tank compartment anchors are hollow, flexible tank compartment anchors, and, the tank compartment anchors and sheet material are formed of the same material. The sheet material is rectangular from a top view and has four edges, the four edges being two sets of two opposite edges. There are at least two edges opposite one another, which contain a plurality of tank compartment anchors.

Applicant believes that another reference corresponds to U.S. Pat. No. 7,299,588 issued to Diaz, et al. on Nov. 27, 2007 for Roof Tarp. However, it differs from the present invention because Diaz, et al. teach a roof tarp, which is square or rectangular shaped tarp and has a first and a second face. The tarp has a tar strip that runs parallel and abuts all edges of the tarp, the tar strip is at-least two and a half inches in width from each edge of the tarp and is at-least a half inch in height from the first face of the tarp. A cellophane covering overlaps the tar strip. A ridge is defined on the first face of the tarp. The ridge is adjacent to the tar strip and runs parallel to the tar strip. The ridge is at least half an inch in height. A first hook and loop material attachment means that is attached to the first face of the tarp and that runs parallel and is adjacent to the ridge of the tarp, the hook and loop attachment means is at least a half an inch inwards from the ridge. A second hook and loop attachment means attached to the second face of the tarp, the second hook and loop attachment means is located the same distance from the edges of the tarp as the first hook and loop attachment means. On each corner of the tarp, there is grommet attached. A lifting means is attached to the grommet.

Applicant believes that another reference corresponds to U.S. Pat. No. 8,777,516 issued to Michael W. Slutz on Jul. 15, 2014 for Tarp and ballast system. However, it differs from the present invention because Slutz teaches an improved tarp and ballast system that includes a plurality of panels attached to one another along the lengths thereof, wherein the lengths of the panels correspond to the length of the tarp. The tarp also includes chain pockets located at the sides of the tarp, which run the length of the tarp and have chains secured therein. The tarp further includes a plurality of cable pockets and associated ballast anchors oriented across the width of the tarp, which are adapted to secure a plurality of ballast cables to the tarp.

Applicant believes that another reference corresponds to U.S. Pat. No. 9,021,749 issued to Arvo Poldmaa on May 5, 2015 for Temporary roof anchor having shock absorbing means. However, it differs from the present invention because Poldmaa teaches a temporary roof anchor for fitment to a roof support structure, the roof anchor comprising: first attachment means for temporary fitment to the roof support structure; second attachment means remote from the first attachment means for attaching safety equipment; and shock-absorbing means having a deformable region extending between the first and second attachment means in a first length when not subject to a deformation force corresponding to a critical sudden load, the shock-absorbing means lying substantially in a single plane and comprising a substantially rigid structure that, when subject to the critical sudden load, deforms, elongating to a greater length than the first length.

Applicant believes that another reference corresponds to U.S. Pat. No. 9,327,147 issued to Snider, et al. on May 3, 2016 for Roof Anchor. However, it differs from the present invention because Snider, et al. teach a roof anchor that comprises a pliable member including an interconnecting portion interconnecting a first portion and a second portion. The first portion and the second portion each include a securing portion with a plurality of apertures and a connecting portion with an aperture. A first notch and a second notch are proximate the junctures of each securing portion and connecting portion. The first notch and the second notch extend inward from opposing sides and toward proximate a middle of the respective first and second portions, and an aperture is between each first notch and second notch.

Applicant believes that another reference corresponds to U.S. Patent Application Publication No. 2002/0095898, published on Jul. 25, 2002 to Joseph A. Bettencourt, for Modular-tarp building-roof/wall shielding and system. However, it differs from the present invention because Bettencourt teaches an apparatus and method for protecting architectural-building construction work in progress from potential damaging effects of rain-storms, temporarily sealing-off exposed roof and wall structures from penetration by water; heretofore only facilitated by use of disposable plastic-film sheets or general use tarpaulins. The tarp-system employs a modular array of prefabricated rectangular tarp-panels fabricated from flexible imperforate light-weight/high-strength material sized both for easy one-man handling, which proportional dimensions are assembled over exposed-framing of a building. Each identical tarp-panel and optional ridge-panel employs either a linear anchoring-strip device, or a plurality of spaced apart perimeter and field-area grommet hole reinforced points, either of which accepting easily removable nail or screw fasteners. Abutting modular tarp-panels can be readily assembled as necessary via interconnecting tarp-panel perimeter edges optionally provided with integral weather-flaps configured to close-over the linear-rows of incrementally installed fasteners. The tarp-panels thus become interdependent from wind displacement, and their imperforate interlocking design can also be facilitated via use of tongue-&-groove interlock, cleat-zipper, or hook-&-loop type couplings; making the tarp-panels readily removable when weather clears, allowing rapid disassembly for stacking and stowing in rolled-bundles for future reuse.

Applicant believes that another reference corresponds to U.S. Patent Application Publication No. 2002/0007924, published on Jan. 24, 2002 to Charles C. Hendee for Structural protective windscreen. However, it differs from the present invention because Hendee teaches an apparatus, a windscreen, and method for securing a structure and its roof against damage from high winds, wherein the windscreen is engagable with a track that is secured to the eaves of a house, and, with a coarse fabric such as the sheet attached to the track with strap like elements and connectors and anchoring device for securing the windscreen to the ground preventing damage to the structure.

Applicant believes that another reference corresponds to U.S. Patent Application Publication No. 2005/0217202, published on Oct. 6, 2005 to Michael L. Crook for Roof protection systems for high wind zones. However, it differs from the present invention because Crook teaches a cover for securing the roof a residential home or other building structure from the weather conditions that are associated with severe storms such as hurricanes. At least one protective membrane is disposed adjacent the roofs upper surface. The membrane is configured to cover substantially the entire roof surface. The membrane, which may comprise stretch wrap or shrink wrap, may be adhered in place, for example, using water resistant tape, an adhesive, mechanical fasteners, or a girdle sheet that is wrapped around the vertical walls of the building structure so as to capture the protective membrane between the girdle sheet and the vertical walls. Alternatively, the roof cover may be maintained adjacent the roof substantially entirely through its own physical properties, especially if the roof cover is comprised of stretch or shrink-wrap.

Applicant believes that another reference corresponds to U.S. Patent Application Publication No. 2006/0010815 published on Jan. 19, 2006 to Dixon, et al. for Roof repair system and method. However, it differs from the present invention because Dixon, et al. teach a roof repair system and method for making temporary repairs to a damaged area of a roof. The roof repair system includes a tarpaulin including a front surface having a perimeter with a top edge, a bottom edge, a left side edge, and a right side edge; and a back surface having a perimeter with a top edge, a bottom edge, a left side edge, and a right side edge; front releasable fastening structure attached to the front surface of the tarpaulin about at least a portion of the perimeter of the front surface of the tarpaulin; and back releasable fastening structure attached to the back surface of the tarpaulin about at least a portion of the perimeter of the front surface of the tarpaulin whereby the tarpaulin can be placed over the damaged area of a roof and secured to the roof using the releasable fastening structure without requiring nails or the like to be driven into the undamaged area of the roof.

Applicant believes that another reference corresponds to U.S. Patent Application Publication No. 2009/0013610, published on Jan. 15, 2009 to Peter N. Glynos for Protective tarp with separate anchors having baffles. However, it differs from the present invention because Glynos teaches a protective tarp for covering a mass that includes a flat, flexible sheet material having a top and a bottom and having a peripheral edge, with baffles that extend outwardly from the bottom edge towards the top edge, creating sub-compartments. Along the peripheral edge or along each of at least two of the plurality of edges, and separate unconnected tank compartment anchors, arranged in a predetermined pattern, having at least one fill orifice. The plurality of tank compartment anchors is hollow, flexible, and the tank compartment anchors and sheet material are formed of the same material. The sheet material is rectangular from a top view and has four edges, the four edges being two sets of two opposite edges. There are at least two edges opposite one another, which contain a plurality of tank compartment anchors.

Applicant believes that another reference corresponds to U.S. Patent Application Publication No. 2010/0083587, published on Apr. 8, 2010 to Peter N. Glynos for Protective tarp with plural removable anchor tanks and with size adjustment connectors. However, it differs from the present invention because Glynos teaches a protective tarp, with connectors arranged in a geometrical pattern, for covering a mass, comprising: a) flexible sheet material having top, bottom, predetermined surface area and peripheral edge; b) a plurality of unconnected anchor tank receiving pockets permanently attached to sheet material and separate and apart from one another, and being arranged in a predetermined pattern, each of the plurality of unconnected anchor receiving pockets adapted to receive an independent, removable anchor tank, the independent, removable anchor tank having at least one fill orifice and closure means, and being adapted to be inserted and removed from the anchor tank receiving pocket; and c) a plurality of male/female connectors arranged in a geometrical pattern on the top and the bottom such that when the tarp is folded, at least one the male connectors and at least one of the female connectors are connected, the surface area of the tarp is decreased.

Other patents describing the closest subject matter provide for a number of more or less complicated features that fail to solve the problem in an efficient and economical way. None of these patents suggest the novel features of the present invention.

SUMMARY OF THE INVENTION

The present invention is a strip anchoring system for emergency roof tarp installations, comprising at least one strip assembly, which has a top face having a top cut out and a top cut out face, and a bottom face having a bottom cut out, a bottom cut out face, and a retaining strip, wherein the at least one strip assembly secures a tarp on a roof.

The at least one strip assembly further comprises first and second side edges, first and second ends, and first and second bottom cut out side edges. The top face comprises first and second upper edges. A first face having a first predetermined angle is defined between the first side edge and the first upper edge, and a second face having a second predetermined angle is defined between the second side edge and the second upper edge, wherein the first predetermined angle and the second predetermined angle are approximately the same.

The top cut out face comprises first and second top cut out side edges and at least one top cut out face hole. The at least one strip assembly comprises at least one hole. The bottom face further comprises at least one retaining ring. The at least one retaining ring is positioned around a respective of the at least one hole and the at least one top cut out face hole. The retaining strip protrudes from the bottom face a first predetermined distance, and the at least one retaining ring protrudes from the bottom face a second predetermined distance, wherein the first predetermined distance and the second predetermined distance are approximately the same.

The retaining strip is positioned along a perimeter of the bottom face and extends from the first end to the bottom cut out. The retaining strip protrudes from the bottom face and is adjacent to the first and second side edges, the first end, and the bottom cut out. The bottom cut out face comprises the at least one bottom cut out face hole. The top cut out face and the bottom cut out face are square shaped. The top cut out face has a first predetermined area and the bottom cut out face has a second predetermined area, wherein the first predetermined area and the second predetermined area are approximately the same.

Further comprising a plurality of strip assemblies that may be assembled linearly and/or at ninety degrees. A first strip assembly overlaps with a second strip assembly, a second strip assembly overlaps with a third strip assembly, and so on, to fix the tarp on the roof. The bottom cut out face of the first strip assembly mounts onto the top cut out face of a respective the second strip assembly. The at least one bottom cut out face hole of a first strip assembly aligns with the at least one top cut out face hole of a second strip assembly.

The bottom cut out face mounts onto a respective the top cut out face, whereby the first and second strip assemblies are positioned in a straight line. The bottom cut out face mounts onto a respective top cut out face, whereby the first and second strip assemblies are positioned perpendicularly.

It is therefore one of the main objects of the present invention to provide a strip anchoring system for emergency roof tarp installations.

It is another object of this invention to provide a strip anchoring system for emergency roof tarp installations that has at least one strip assembly.

It is another object of this invention to provide a strip anchoring system for emergency roof tarp installations comprising plurality of strip assemblies.

It is another object of this invention to provide a strip anchoring system that secures tarps onto roofs.

It is another object of this invention to provide a strip anchoring system for emergency roof tarp installations that is volumetrically efficient for carrying, transporting, and storage.

It is another object of this invention to provide a strip anchoring system for emergency roof tarp installations that can be readily assembled and disassembled without the need of any special tools.

It is another object of this invention to provide a strip anchoring system for emergency roof tarp installations, which is of a durable and reliable construction.

It is yet another object of this invention to provide a strip anchoring system for emergency roof tarp installations that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
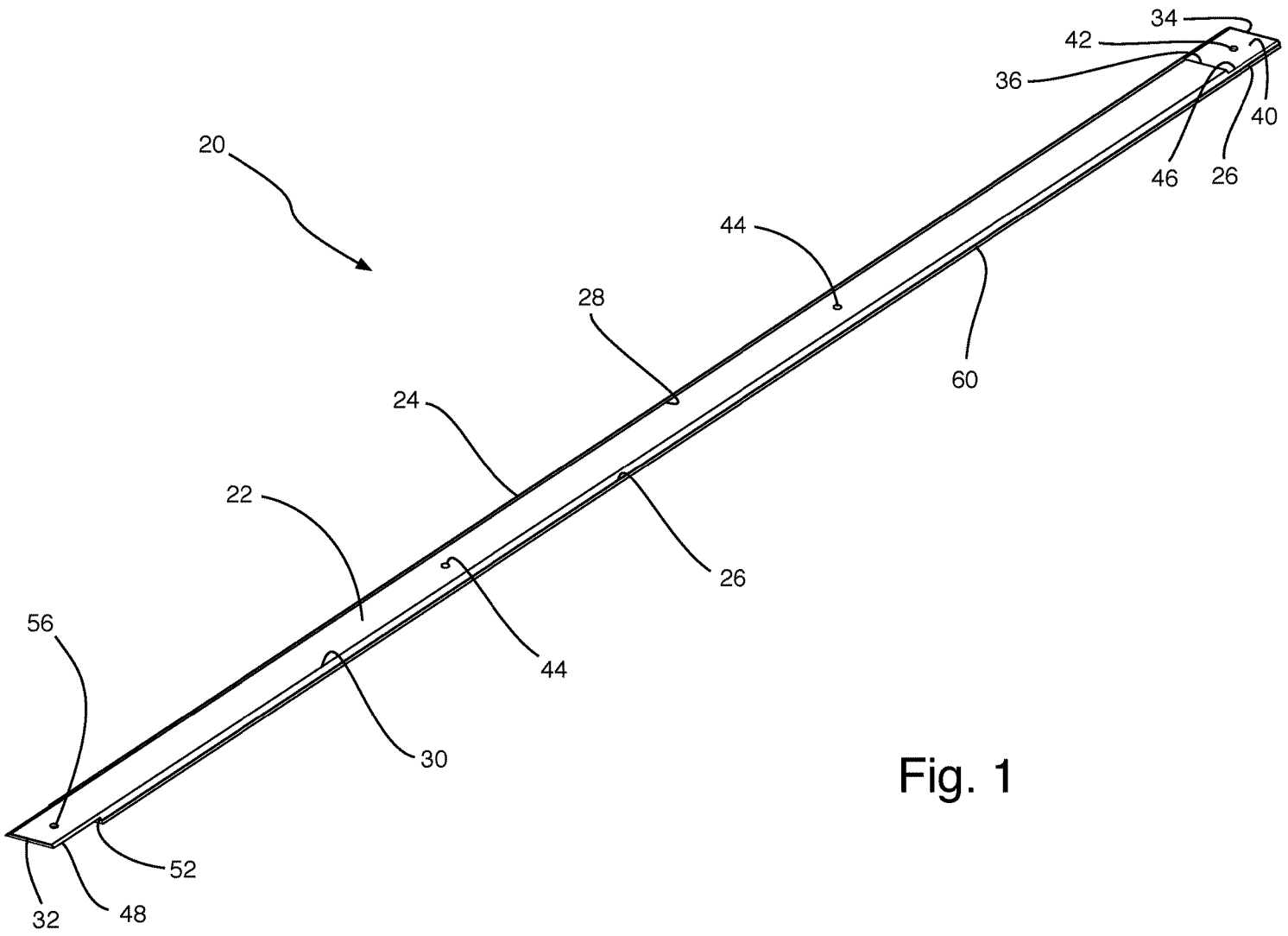
FIG. 1 is an isometric view of a strip assembly of the present invention showing a top face.

Referring now to the drawings, the present invention is a strip anchoring system for an emergency roof tarp installation, and is generally referred to with numeral 10. It can be observed that it basically includes at least one strip assembly 20 and tarp 70.

As seen in FIG. 1, at least one strip assembly 20 comprises top face 22, first side edge 24, second side edge 26, end 32, and end 34. Top face 22 comprises top cut out 36 defining top cut out face 40 and top cut out side edges 46.

In a preferred embodiment, top cut out face 40 comprises top cut out face hole 42, and top cut out face 40 is square shaped.

Top face 22 further comprises first upper edge 28 and second upper edge 30. A first face having a first predetermined angle is defined between first side edge 24 and first upper edge 28, and a second face having a second predetermined angle is defined between second side edge 26 and second upper edge 30, wherein the first predetermined angle and the second predetermined angle are approximately the same.

At least one strip assembly 20 further comprises at least one hole 44. In a preferred embodiment, each strip assembly 20 comprises at least two holes 44 separated a predetermined distance from each other. In addition, strip assembly 20 comprises bottom cut out face hole 56, whereby holes 44, top cut out face hole 42 and bottom cut out face hole 56 allow strip assembly 20 to be fixed onto roof 80 with nails, screws, or any other means of securing. In a preferred embodiment, screws secure strip assembly 20 onto roof 80.

Figure 2:
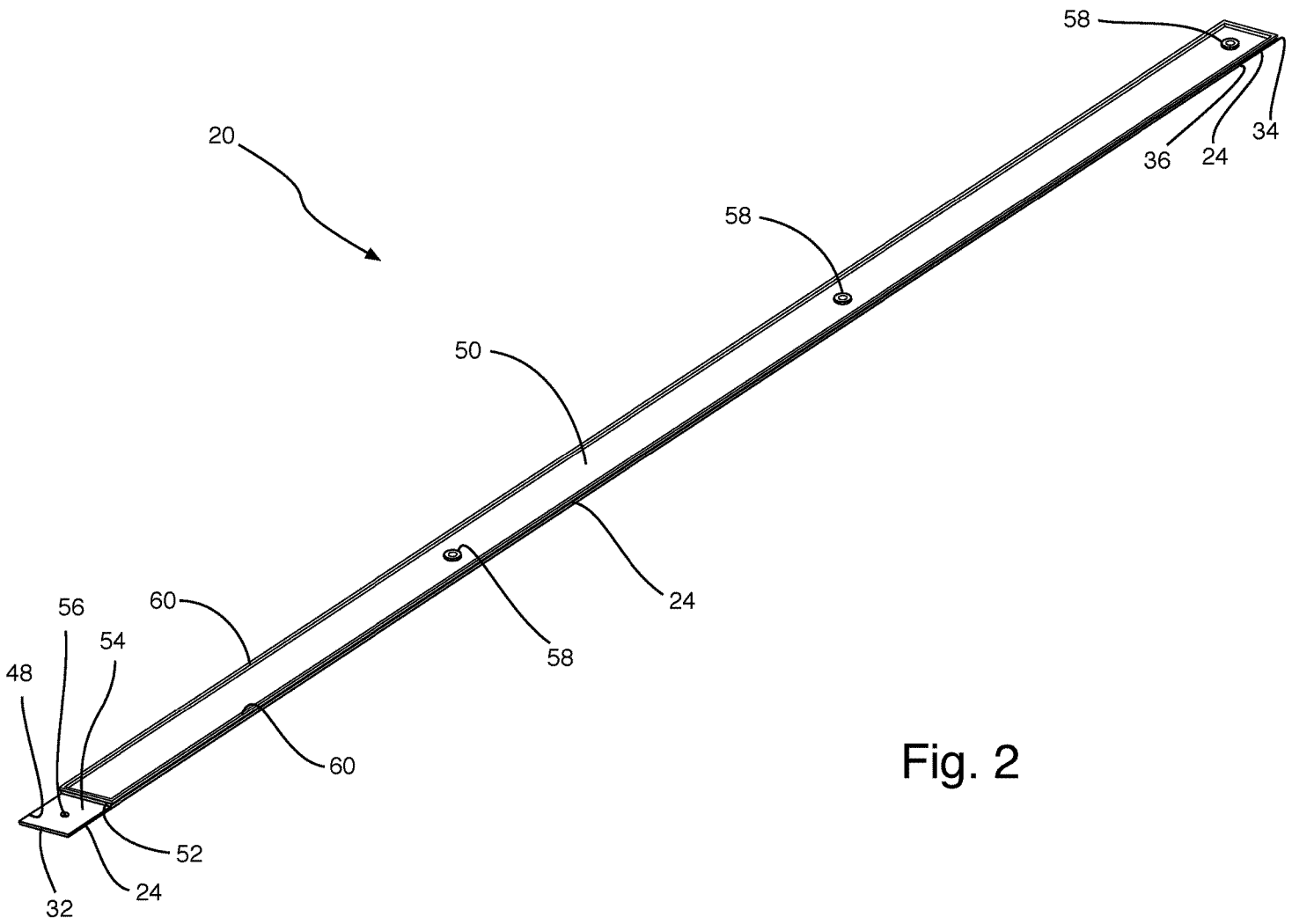
FIG. 2 is an isometric view of the strip assembly of the present invention showing a bottom face.

As seen in FIG. 2, strip assembly 20 further comprises bottom face 50. Bottom face 50 comprises bottom cut out 52 defining bottom cut out face 54 and bottom cut out side edges 48. In a preferred embodiment, bottom cut out face 54 comprises bottom cut out face hole 56, and bottom cut out face 54 is square shaped. Bottom face 50 further comprises at least one retaining ring 58 and retaining strip 60. In a preferred embodiment, there a plurality of retaining rings 58, which are positioned around holes 44 and top cut out face hole 42, as seen in FIG. 1. Retaining strip 60 is positioned along a perimeter of bottom face 50, from end 34 to bottom cut out 52, whereby retaining strip 60 protrudes from bottom face 50 and is aligned with respective first and second side edges 24 and 26, as seen in FIGS. 1 and 2.

Retaining strip 60 protrudes from bottom face 50 a first predetermined distance, and at least one retaining ring 58 protrudes from bottom face 50 a second predetermined distance, wherein the first predetermined distance and the second predetermined distance are approximately the same. Retaining strip 60 and retaining rings 58 function to prevent water or moisture from accumulating therein and penetrating into roof 80 when screws secure strip assembly 20 onto roof 80.

Figure 3:
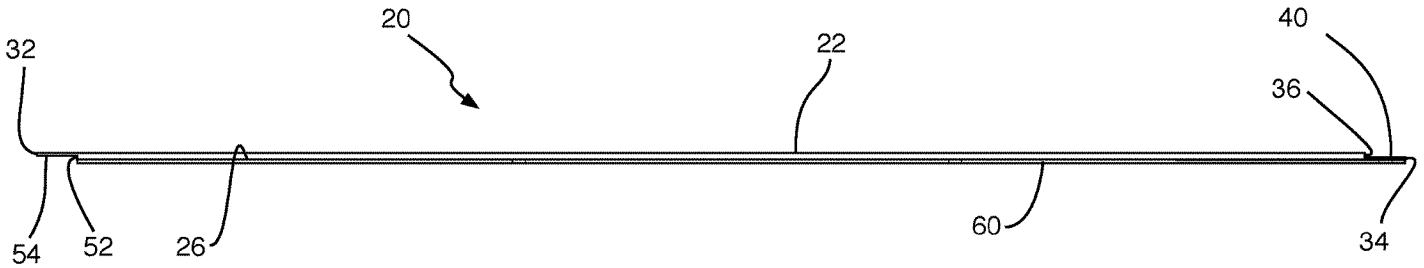
FIG. 3 is a front view of the strip assembly of the present invention.

As seen in FIG. 3, top cut out 36 has a first predetermined height and bottom cut out 52 has a second predetermined height, wherein the first predetermined height and the second predetermined height are approximately the same. This enables top cut out face 40 of a first strip assembly 20 to receive bottom cut out face 54 of a second strip assembly 20.

Figure 4B:
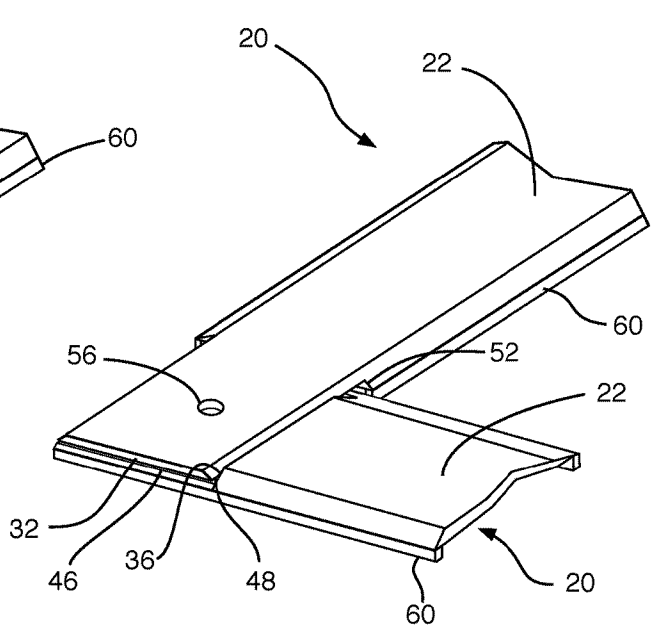
FIG. 4B is an isometric view of a first strip assembly mounted onto a second strip assembly at ninety degrees or perpendicularly.
Figure 4A:
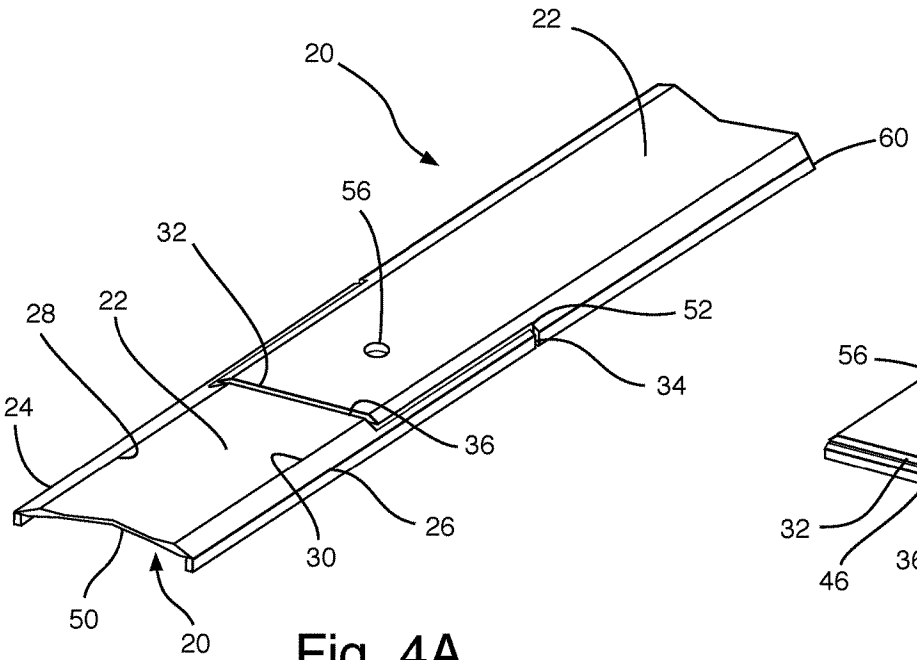
FIG. 4A is an isometric view of a first strip assembly mounted onto a second strip assembly in a straight line.

As seen in FIG. 4A, a first strip assembly 20 overlaps with a second strip assembly 20, whereby a respective bottom cut out face 54, seen in FIG. 2, mounts onto a respective top cut out face 40, seen in FIG. 1. The first strip assembly 20 and the second strip assembly 20 may be positioned linearly, to form a straight line, whereby end 32 of the second strip assembly 20 aligns with top cut out 36 of the first strip assembly 20, and end 34 of the first strip assembly 20 aligns with bottom cut out 52 of the second strip assembly 20. Top cut out face 40, seen in FIG. 1, has a first predetermined area, and bottom cut out face 54, seen in FIG. 2, has a second predetermined area, wherein the first predetermined area and the second predetermined area are approximately the same.

As seen in FIG. 4B, a first strip assembly 20 and a second strip assembly 20 may be positioned at ninety degrees, perpendicularly, whereby end 32 and bottom cut out 52 of the second strip assembly 20 align with respective first and second top cut out side edges 46 of the first strip assembly 20, and bottom cut out side edges 48 of the second strip assembly 20 align with top cut out 36 of the first strip assembly 20. In addition, at least one bottom cut out face hole 56 aligns with at least one top cut out face hole 42.

Figure 5:
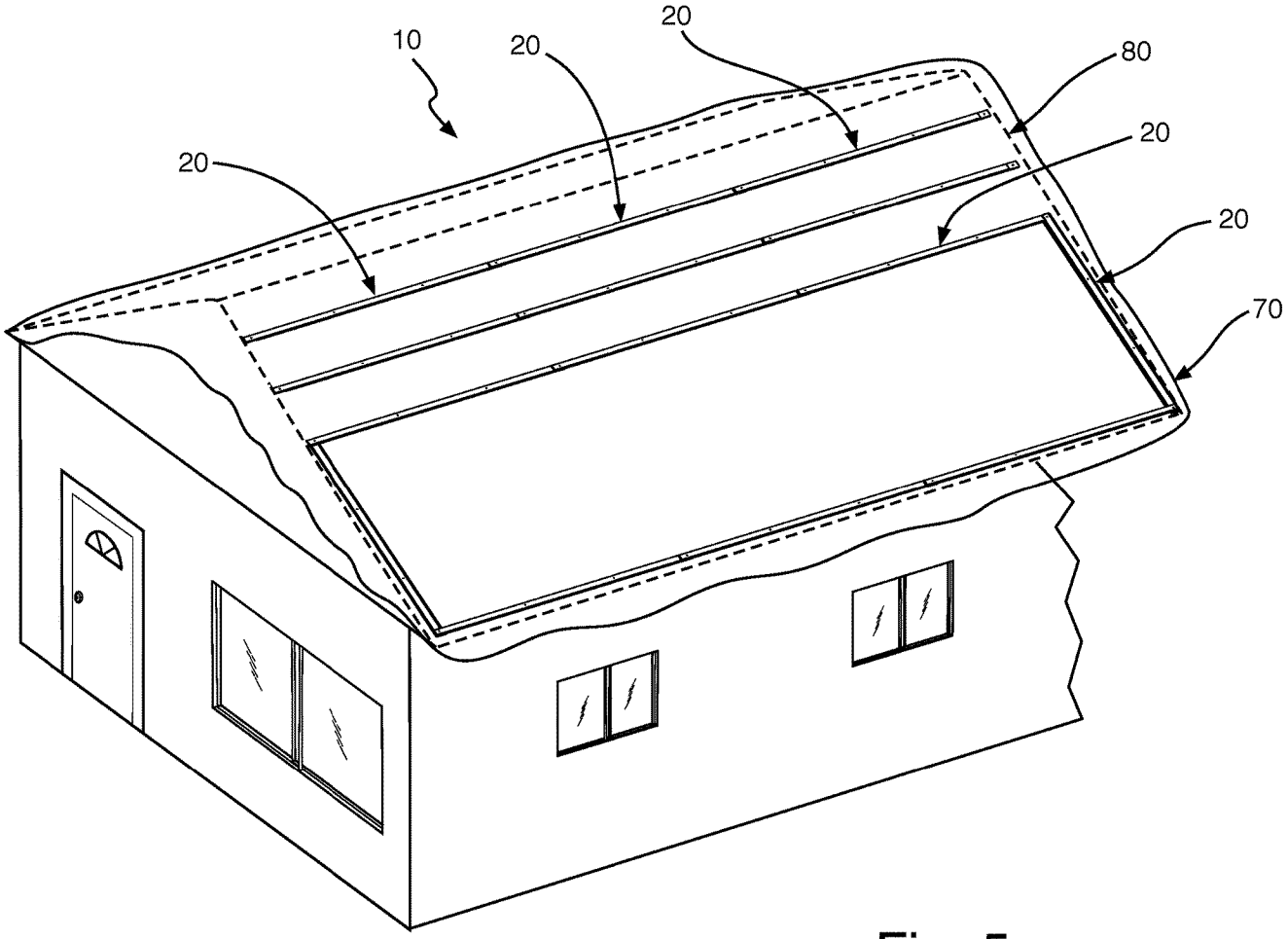
FIG. 5 is an isometric view of a plurality of strip assemblies securing a tarp onto a roof.

As seen in FIG. 5, at least one strip assembly 20 secures tarp 70 onto roof 80. Present invention 10 comprises a plurality of strip assemblies 20. As an example, a first strip assembly 20 overlaps with a second strip assembly 20, and the second strip assembly 20 overlaps with a third strip assembly 20, and so on, until a predetermined length is obtained to secure fix tarp 70 on roof 80.

In a preferred embodiment, strip assembly 20 is made of a semi-flexible and weather resistant plastics, fiberglass, and/or other materials having similar characteristics.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A strip anchoring system for emergency roof tarp installation, comprising at least one strip assembly, which has a top face having a top cut out and a top cut out face, and a bottom face having a bottom cut out, a bottom cut out face, and a retaining strip, wherein said at least one strip assembly secures a tarp on a roof, said at least one strip assembly further comprises first and second side edges, first and second ends, and first and second bottom cut out side edges, said top face comprises first and second upper edges, a first face having a first predetermined angle is defined between said first side edge and said first upper edge, and a second face having a second predetermined angle is defined between said second side edge and said second upper edge, wherein said first predetermined angle and said second predetermined angle are approximately the same.

2. The strip anchoring system for emergency roof tarp installation set forth in claim 1, further characterized in that said top cut out face comprises first and second top cut out side edges and at least one top cut out face hole.

3. The strip anchoring system for emergency roof tarp installation set forth in claim 2, further characterized in that said at least one strip assembly comprises at least one hole.

4. The strip anchoring system for emergency roof tarp installation set forth in claim 3, further characterized in that said bottom face further comprises at least one retaining ring.

5. The strip anchoring system for emergency roof tarp installation set forth in claim 4, further characterized in that said at least one retaining ring is positioned around a respective of said at least one hole and said at least one top cut out face hole.

6. The strip anchoring system for emergency roof tarp installation set forth in claim 4, further characterized in that said retaining strip protrudes from said bottom face a first predetermined distance, and said at least one retaining ring protrudes from said bottom face a second predetermined distance, wherein said first predetermined distance and said second predetermined distance are approximately the same.

7. The strip anchoring system for emergency roof tarp installation set forth in claim 1, further characterized in that said retaining strip is positioned along a perimeter of said bottom face and extends from said first end to said bottom cut out.

8. The strip anchoring system for emergency roof tarp installation set forth in claim 1, further characterized in that said retaining strip protrudes from said bottom face and is adjacent to said first and second side edges, said first end, and said bottom cut out.

9. The strip anchoring system for emergency roof tarp installation set forth in claim 5, further characterized in that said bottom cut out face comprises said at least one bottom cut out face hole.

10. The strip anchoring system for emergency roof tarp installation set forth in claim 1, further characterized in that said top cut out face and said bottom cut out face are square shaped.

11. The strip anchoring system for emergency roof tarp installation set forth in claim 1, further characterized in that said top cut out face has a first predetermined area and said bottom cut out face has a second predetermined area, wherein said first predetermined area and said second predetermined area are approximately the same.

12. The strip anchoring system for emergency roof tarp installation set forth in claim 1, further comprising a plurality of strip assemblies that may be assembled linearly and/or at ninety degrees.

13. The strip anchoring system for emergency roof tarp installation set forth in claim 1, further characterized in that a first strip assembly overlaps with a second strip assembly, a second strip assembly overlaps with a third strip assembly, and so on, to fix said tarp on said roof.

14. The strip anchoring system for emergency roof tarp installation set forth in claim 13, further characterized in that said bottom cut out face of said first strip assembly mounts onto said top cut out face of a respective said second strip assembly.

15. The strip anchoring system for emergency roof tarp installation set forth in claim 9, further characterized in that said at least one bottom cut out face hole of a first strip assembly aligns with said at least one top cut out hole face of a second strip assembly.

16. The strip anchoring system for emergency roof tarp installation set forth in claim 13, further characterized in that said bottom cut out face mounts onto a respective said top cut out face, whereby said first strip assembly and said second strip assembly are positioned in a straight line.

17. The strip anchoring system for emergency roof tarp installation set forth in claim 13, further characterized in that said bottom cut out face mounts onto a respective said top cut out face, whereby said first strip assembly and said second strip assembly are positioned perpendicularly.

* * * * *